United States Patent [19]

Benn et al.

[11] 4,401,622

[45] Aug. 30, 1983

[54] NICKEL-CHROMIUM-IRON ALLOY

[75] Inventors: Raymond C. Benn, Suffern, N.Y.; John R. Mihalisin, North Caldwell, N.J.; Leroy R. Curwick, Warwick; Howard F. Merrick, Suffern, both of N.Y.

[73] Assignees: The International Nickel Co., Inc., New York, N.Y.; Howmet Corporation, Dover, N.J.

[21] Appl. No.: 255,357

[22] Filed: Apr. 20, 1981

[51] Int. Cl.[3] ..... C22C 19/05

[52] U.S. Cl. ..... 420/449; 420/448; 420/582; 420/584; 420/586

[58] Field of Search ..... 75/171, 170, 122, 134 F

[56] References Cited

U.S. PATENT DOCUMENTS

| | | | |
|---|---|---|---|
| 2,688,536 | 9/1954 | Callaway et al. | 75/171 |
| 2,860,968 | 11/1958 | Boegehold et al. | 75/122 |
| 2,941,882 | 6/1960 | Franklin et al. | 75/123 |
| 3,048,485 | 8/1962 | Bieber | 75/128 |
| 3,157,495 | 11/1964 | Eiselstein et al. | 75/134 |
| 3,573,901 | 4/1971 | Economy | 75/171 |
| 3,758,295 | 9/1973 | Morley | 75/122 |

*Primary Examiner*—R. Dean

*Attorney, Agent, or Firm*—Raymond J. Kenny

[57] ABSTRACT

A nickel-chromium-iron alloy intended principally for automotive turbocharger applications, the alloy being characterized by good stress - rupture strength, ductility, tensile strength, etc. and containing, generally speaking, 10–15% Cr, 18–30% Fe, 3–4.25% Ti, 2.25–3.5% Al, Ti+Al from 6 to 7.25%, ratio of Ti to Al of at least 0.9 and up to 1.6, 4–6% Mo, 0.01–0.2% B, 0.03–0.3% C, balance essentially nickel.

6 Claims, No Drawings

NICKEL-CHROMIUM-IRON ALLOY

The present invention relates to high temperature, creep resistant, nickel-chromium-iron alloys, and is principally, though not exclusively, directed to novel nickel-chromium-iron alloys suitable for use as components in turbocharger applications.

While conceptually turbocharger technology is not of recent origin, it was not until a few years ago that it was successfully introduced in the U.S. automotive passenger car market. The high level of acceptance generated has led some sources to predict that in the not too distant future at least 25% of the automotive market will utilize turbochargers.

Concomitant with this predicted development it can be expected that considerable emphasis will be placed (if this is not already the case) on the development of more economical turbocharger alloys, e.g., for integrally cast wheels. This is probably the primary reason why the alloy designated as GMR 235 (nominally 15.5Cr, 5.25Mo, 10Fe, 3Al, 2Ti, 0.03B, 0.15C) was selected in the first instance for the integral cast wheels in preference to, say, Alloy 713C, a cast alloy well known and long established in the superalloy integral wheel market. But a low cost material developed at the expense of mechanical properties, including elevated temperature strength and ductility, or ease of castability, would hardly be a panacea. Accordingly, the desideratum is an alloy which is significantly more economical than Alloy 235 and which, at the same time, is capable of delivering a combination of mechanical and other characteristics which compare favorably with Alloy 235.

It has now been discovered that certain nickel-chromium-iron alloys containing controlled and correlated percentages of titanium and aluminum and other constituents as well, manifest an attractive combination of strength and ductility at a considerably reduced cost in comparison with the Alloy 235. In this regard, it has been found that alloys within the invention afford in the as-cast condition, stress rupture lives well in excess of 50 hours and ductilities in excess of 5% at a temperature of 1400° F. and under a stress of 60,000 psi, this being considered as a minimum combination of properties.

It has also been ascertained that various alloys within the subject invention are characterized by lower densities, and hence higher specific strengths, than Alloy 235. In this connection, higher specific strengths would indicate that smaller integral wheels could be used which should bring about a reduction in wheel inertia which in turn should enhance turbocharging response time (i.e., reduce "turbo-lag").

Generally speaking, alloys of the invention contain about 10–12.5% chromium, 18–27% iron, 4–6% molybdenum, 3–4.25% titanium, 2.25–3.5% aluminum, the titanium and aluminum being correlated as hereinafter described, boron about 0.01–0.2%, 0.03–0.3% carbon, the balance being essentially nickel. In referring to nickel as constituting the "balance" or "essentially the balance", it will be understood by those skilled in the art that the presence of other constituents are not excluded, such as those commonly present as incidental elements, e.g., deoxidizing and cleansing elements, and impurities ordinarily associated therewith in amounts which do not adversely affect the basic characteristics of the alloys.

In carrying the invention into practice, it is important that the elements titanium and aluminum and also iron be carefully controlled. (This is not to say that care should not be exercised in respect of the other constituents.) Thus, in seeking optimum results at least two compositional relationships are to be observed, to wit: (i) the sum total of the percentage of titanium and aluminum, and (ii) the ratio of titanium to aluminum. Given this, the sum of titanium plus aluminum should be from 6% to 7.25% with the ratio therebetween being from about 0.9–1.6.

Should titanium be present to the excess, say 5% or more, or the ratio of titanium to aluminum be excessively high, the chance of eta or other undesired phases forming is unnecessarily increased. Such phases markedly detract from such properties as ductility. While the titanium plus aluminum might be extended downward for certain applications, high temperature strength, including both tensile and stress rupture strengths, suffer. The percentage of titanium advantageously should exceed that of aluminum since it is more potent in imparting strengthening and hardening characteristics. It is deemed particularly beneficial that the titanium plus aluminum be from 6.25 to 7% with the ratio of titanium to aluminum being from 1.1 to about 1.4.

With regard to iron while percentages above 27% and up to 30% can be utilized, greater would be the tendency for unwanted morphological phases to occur and possible loss of ductility. This could needlessly subvert the basic properties of the alloys. To go to lower iron levels, i.e., below 18%, is self-defeating, the only result being to increase cost. And this was the problem to overcome at the outset. A highly satisfactory iron range is from 22 to 26%.

Chromium is present mainly to contribute resistance to the ravages of corrosive environments. In accordance with the instant invention, chromium levels about 12.5% add relatively little for turbocharger applications. Though higher percentages can be used, say up to 15%, particularly where maximum corrosion resistance is required, a range of 10.5% to 12% is generally quite suitable. Boron confers resistance to creep. If boron is controlled within the range of 0.08% to 0.12%, virtually an optimum combination of strength and ductility is achieved. High percentages of boron could form an excessive amount of borides and this would tend to induce brittleness. It is contemplated that zirconium from 0.1 to 1% can be used in lieu of or together with boron. Carbon forms carbides (MC and $M_{23}C_6$) which in turn lend to strength. The lower carbon levels, 0.12 to 0.16, contribute to castability.

In respect of other elements, vanadium, tungsten, columbium and tantalum, all carbide formers, can be present up to 1%. The alloys can contain up to 2% hafnium as well as up to 5% cobalt. Manganese, silicon and copper need not exceed 1%. Interstitials should be kept low consistent with good production practices.

For the purpose of giving those skilled in the art a better appreciation of the invention, the following illustrative data are given:

A number of compositions (Table I) were prepared both within (Alloys 1–2) and without (Alloys A–F) the invention. The alloys were prepared by vacuum induction melting and cast as stick. After dressing, the stick (17 lbs. each) was vacuum remelted (with additions as required) and vacuum cast into investment cast-to-size molds (8" bar/4½" dia. base). The molds were preheated to 1800° F. and the metals poured at rim temperature +285° F. Mold transfer time from preheat furnace to pour was maintained at ≦22 minutes. Exothermic mix was added to the mold immediately after pouring.

TABLE I

| Alloy | Cr | Mo | C | B | Fe | Ti | Al | Ti+Al | Ti/Al |
|---|---|---|---|---|---|---|---|---|---|
| | COMPOSITIONS | | | | | | | | |
| 1 | 12.1 | 4.8 | 0.14 | 0.083 | 19.4 | 3.5 | 2.94 | 6.44 | 1.19 |
| 2 | 12.1 | 4.9 | 0.14 | 0.086 | 23.2 | 3.8 | 2.60 | 6.40 | 1.46 |
| A | 11.9 | 5.3 | 0.13 | 0.074 | 24.3 | 3.3 | 1.68 | 4.98 | 1.96 |
| B | 11.6 | 5.2 | 0.14 | 0.086 | 24.1 | 3.7 | 1.59 | 5.29 | 2.32 |
| C | 12.1 | 4.9 | 0.12 | 0.067 | 19.4 | 3.4 | 2.13 | 5.53 | 1.60 |
| D | 12.3 | 5.0 | 0.13 | 0.073 | 19.8 | 3.0 | 2.17 | 5.17 | 1.38 |
| E | 11.9 | 5.0 | 0.13 | 0.091 | 19.3 | 4.0 | 2.13 | 6.13 | 1.88 |
| F | 12.1 | 4.9 | 0.13 | 0.097 | 20.0 | 3.6 | 2.07 | 5.67 | 1.74 |

The alloys given in Table I were tested at 1400° F. under a stress of 60,000 psi and the results, stress rupture, elongation and reduction in area, are reported in Table II.

TABLE II

| Alloy | Ti | Al | Ti+Al | Ti/Al | Rupture Life, Hrs | Elong. % | Reduction of Area, % |
|---|---|---|---|---|---|---|---|
| 1 | 3.5 | 2.94 | 6.44 | 1.19 | 158.1 | 11.1 | 15.4 |
| 2 | 3.8 | 2.60 | 6.40 | 1.46 | 83.65 | 9.35 | 11.4 |
| A | 3.3 | 1.68 | 4.98 | 1.96 | 26.55 | 10.7 | 23.0 |
| B | 3.7 | 1.59 | 5.29 | 2.32 | 7.9 | 17.4 | 27.8 |
| C | 3.4 | 2.13 | 5.53 | 1.60 | 31.2 | 17.7 | 28.8 |
| D | 3.0 | 2.17 | 5.17 | 1.38 | 23.95 | 15.55 | 24.3 |
| E | 4.0 | 2.13 | 6.13 | 1.88 | 43.5 | 11.2 | 21.0 |
| F | 3.6 | 2.07 | 5.67 | 1.74 | 21.7 | 22.2 | 34.6 |

The data set forth in Table II, given the chemistry of Table I, clearly reflect that the alloys representative of the invention are significantly superior to those beyond the scope thereof. In this connection Alloys A-F either did not have a sufficient amount of titanium plus aluminum and/or the Ti/Al ratios were well beyond the upper range of 1.6. Alloy E, for example, had a sum of titanium plus aluminum of 6.13%, a percentage otherwise within the invention; yet, it manifested inferior strength. Alloy D, on the other hand, had an acceptable Ti/Al ratio but a low level of Ti plus Al. It is perhaps worthy of mention that Alloys 1 and 2 have lower densities, approximately 0.28 lb/in$^3$, and hence higher specific strength, than Alloy 235 )approximately 0.29 lb/in$^3$). This suggests that such alloys can be produced as smaller integral wheels which in turn indicates a savings in space "under the hood" and a reduction in wheel inertia. Turbocharger response time could be improved.

Alloys 3, 4 and 5, Table III, are representative of larger size heats (approximately 35 lbs) which were cast as stick and remelted and then cast as cast-to-size test bars as previously described.

TABLE III

| Alloy | Cr | Mo | C | B | Fe | Ti | Al | Ti+Al | Ti/Al |
|---|---|---|---|---|---|---|---|---|---|
| 3 | 11.9 | 4.9 | 0.13 | 0.10 | 19.7 | 3.47 | 3.1 | 6.57 | 1.12 |
| 4 | 11.8 | 4.9 | 0.14 | 0.08 | 24.4 | 3.49 | 3.1 | 6.59 | 1.13 |
| 5 | 11.9 | 4.9 | 0.15 | 0.12 | 19.6 | 3.60 | 2.9 | 6.50 | 1.24 |

The results are given in Table IV. In this connection the ductility of Alloy 4 was slightly low. This was due, it is believed, to the general difficulty experienced in testing cast-to-size specimens. As is known, such specimens in the investment wax preparation stage may tend to become bent or warped. During test, this "bowed-out" effect is straightened during tensile testing. Put another way, there is non-uniform deformation across the gauge length under test. This effect reduces ductility, although it may increase stress rupture life. One alloy similar to Alloys 3–5 exhibited virtually nil ductility by reason of this aspect.

TABLE IV

| Alloy | Ti | Al | Ti+Al | Ti/Al | Rupture Life, Hrs | Elong. % | Reduction of Area, % |
|---|---|---|---|---|---|---|---|
| 3 | 3.47 | 3.1 | 6.57 | 1.12 | 172 | 8.5 | 15.2 |
| 4 | 3.49 | 3.1 | 6.59 | 1.13 | 65.1 | 4.5 | 10.2 |
| 5 | 3.60 | 2.9 | 6.50 | 1.24 | 245.6 | 6.5 | 11.6 |

In an effort to ascertain whether the alloys typified by the compositions in Tables I and III would manifest the property levels delineated in Tables II and IV larger size heats were made, including a commercial production size heats (Table VII). In this connection, two 100-lb heats were tested in cast-to-size form and also in the form of an integrally cast wheel, the test specimen being taken directly from the hub of the wheel. The chemistries are given in Table V with the properties being reported in Table VI. The commercial scale heat was also tested in the form of an integrally cast wheel.

TABLE V

| Alloy | Cr | Mo | C | B | Fe | Ti | Al | Ti+Al | Ti/Al |
|---|---|---|---|---|---|---|---|---|---|
| 6* | 11.5 | 5.0 | 0.15 | 0.10 | 23.5 | 3.75 | 2.6 | 6.25 | 1.44 |
| 7* | 12.05 | 4.9 | 0.14 | 0.1 | 19.6 | 3.6 | 3.03 | 6.63 | 1.19 |

*average of two analyses

TABLE VI

| | | | | | Cast-to-size | | Integral Wheel | |
|---|---|---|---|---|---|---|---|---|
| Alloy | Ti | Al | Ti+Al | Ti/Al | Rupture Life, Hrs | E-long. % | Rupture Life, hrs | E-long. % |
| 6 | 3.7 | 2.55 | 6.25 | 1.45 | 71.05 | 20.0 | 188.8 | 7.4 |
| 7 | 3.6 | 3.05 | 6.65 | 1.18 | 275.2 | 6.5 | 254.1 | 9.2 |

The results in Table VI confirmed that excellent properties were obtainable from a cast integral wheel per se, particularly in respect of the higher titanium plus aluminum level of Alloy 7.

Alloy 8, Tables VII and VIII, represents what can be expected on a commercial production basis. A four thousand pound heat was vacuum cast into stick, remelted and cast into a turbocharger integrally cast wheel. To obtain a comparative base, the standard Alloy 235 was similarly prepared and tested. Since the properties for Alloy 235 are often reported for the test conditions of 1500° F. and 35,000 psi, this set of conditions was used (Table VIII).

TABLE VII

| Alloy | Cr | Mo | C | B | Fe | Ti | Al | Ti+Al | Ti/Al |
|---|---|---|---|---|---|---|---|---|---|
| 8 | 11.8 | 5.45 | 0.14 | 0.09 | 24.37 | 3.30 | 2.7 | 6.0 | 1.22 |
| 235 | 15.3 | 4.83 | 0.14 | 0.04 | 9.85 | 1.89 | 3.7 | 5.59 | 0.51 |

TABLE VIII

| Alloy | Ti | Al | Ti+Al | Ti/Al | Rupture Life, Hrs | Elong. % | Reduction of Area, % |
|---|---|---|---|---|---|---|---|
| 8 | 3.30 | 2.7 | 6.0 | 1.22 | 431.9 | 10.85 | 24.4 |
| 235 | 1.89 | 3.7 | 5.59 | 0.51 | 268.7 | 13.8 | 24.9 |

The data of Table VIII clearly demonstrate that alloys within the present invention compare more than favorably with the Alloy 235 standard. These data together with that in Table VI were used to make a Larson Miller plot. By extrapolation at 1400° F. and 60,000 psi it was determined that Alloy 8 had a rupture life of approximately 290 hours in comparison with 45 hours for Alloy 235.

A series of tensile tests were conducted in respect of the production heat of Tables VII and VIII. In this regard Alloy 8 was remelted (Alloy 9) and tensile tested at room temperature and various elevated temperatures, 1200° F. being reported in Table X. An Alloy 235 commercial heat was also comparison tested, the results being set forth in Table X.

TABLE IX

| Alloy | Ni | Cr | Mo | C | B | Fe | Ti | Al | Ti+Al | Ti/Al |
|---|---|---|---|---|---|---|---|---|---|---|
| 9 | Bal | 11.4 | 5.0 | 0.13 | 0.097 | 22.6 | 3.7 | 3.0 | 1.23 | 6.70 |
| 235 | Bal | 15.6 | 5.2 | 0.16 | 0.062 | 9.5 | 1.8 | 3.5 | 0.51 | 5.30 |

TABLE X

| Alloy | Condition | Temp (°F.) | 0.2% YS (ksi) | UTS (ksi) | El. (%) | R.A. (%) |
|---|---|---|---|---|---|---|
| 9 | as-cast | RT | 115.7 | 155.7 | 4.0 | 5.0 |
| 9 | as-cast | RT | 113.8 | 159.0 | 5.0 | 8.0 |
| 9 | as-cast | 1200 | 110.8 | 164.1 | 6.0 | 4.5 |
| 9 | as-cast | 1200 | 115.3 | 165.6 | 5.0 | 6.0 |
| 9 | as-cast and exposed in air at 1600° F. for 1500 hr. | RT | 81.5 | 139.9 | 9.0 | 10.0 |
| 9 | as-cast and exposed in air at 1600° F. for 1500 hr. | RT | 81.2 | 134.8 | 8.0 | 8.0 |
| 235 | as-cast | RT | 102.7 | 134.7 | 5.0 | 3.5 |
| 235 | as-cast | 1200 | 92.9 | 123.2 | 4.0 | 6.5 |

Table X indicates superior tensile properties for the alloy within the invention over Alloy 235. The excellent retained ductility of Alloy 9 after 1500 h/1600° F. exposure indicates a stable composition free of embrittling TCP phases such as sigma.

In light of the foregoing, it is preferred that the alloys of the subject invention contain 10.5 to 12.5% chromium, 22–26% iron 4.5 to 5.5% molybdenum, 3 to 4% titanium, 2.6% to 3.3% aluminum, the titanium plus aluminum being 6.25 to 7 with the ratio being from 1.1 to about 1.4, 0.08 to 0.12% boron, 0.12 to 0.16% carbon, and the balance nickel.

In addition to turbocharger components alloys of the invention are deemed useful for turbine and automotive engine components in general, including blades, buckets and nozzle diaphragm vanes. Engine casings and other cast parts can be produced.

We claim:

1. A high temperature, creep resistant alloy adapted for turbocharger applications and characterized by a stress-rupture life of 50 hours or more and an elongation of 5% or greater when tested at 1400° F. and 60,000 psi, said alloy consisting essentially of from about 3 to 4.25% titanium, about 2.25 to 3.5% aluminum, the sum of the titanium plus aluminum being about 6.25 to 7% with the ratio therebetween being about 1.1 to 1.4, about 10 to 12.5% chromium, about 4 to 6% molybdenum, about 22 to 26% iron, about 0.08 to 0.12% boron, about 0.12 to 0.16% carbon and the balance essentially nickel.

2. As a new article of manufacture, a turbocharger component formed of the alloy set forth in claim 1.

3. The alloy of claim 1 in which the titanium is from 3 to 4% and the aluminum is from 2.6 to 3.3%.

4. A high temperature, creep resistant alloy adapted for turbocharger application and characterized by a stress-rupture life of 50 hours or more and an elongation of 5% or greater when tested at 1400° F. and 60,000 psi, said alloy consisting essentially of from about 3 to 4.25% titanium, about 2.25 to 3.5% aluminum, the percentage of titanium being greater than the percentage of aluminum with the sum of the titanium plus aluminum being about 6 to 7.25% and the ratio therebetween not exceeding 1.6, about 10 to 15% chromium, about 4 to 6% molybdenum, 18 to 30% iron, at least one metal from the group of boron and zirconium, the boron being from 0.01 to 0.2% and the zirconium being up to 1%, 0.03 to 0.3% carbon and the balance essentially nickel.

5. As a new article of manufacture, a turbocharger component formed of the alloy set forth in claim 4.

6. The alloy of claim 3 containing up to 1% each of vanadium, columbium, tungsten and tantalum, up to 5% cobalt, up to 2% hafnium and up to 1% each of manganese, silicon and copper.

* * * * *